United States Patent [19]

Kawasaki et al.

[11] 4,317,103

[45] Feb. 23, 1982

[54] VARIABLE RESISTOR

[75] Inventors: Atsushi Kawasaki; Yukio Munakata, both of Tokorozawa, Japan

[73] Assignee: Pioneer Electronic Corporation, Tokyo, Japan

[21] Appl. No.: 58,648

[22] Filed: Jul. 19, 1979

[30] Foreign Application Priority Data

| | | | |
|---|---|---|---|
| Jul. 21, 1978 | [JP] | Japan | 53/99643[U] |
| Jul. 21, 1978 | [JP] | Japan | 53/99644[U] |
| Jul. 21, 1978 | [JP] | Japan | 53/99645[U] |
| Aug. 16, 1978 | [JP] | Japan | 53/99119 |
| Aug. 16, 1978 | [JP] | Japan | 53/111478[U] |

[51] Int. Cl.[3] ..... H01C 10/30; H01C 10/36

[52] U.S. Cl. ..... 338/160; 337/3; 338/172; 338/200

[58] Field of Search ..... 338/160, 161, 162, 139, 338/191, 200, 172, 173, 163; 337/102, 103; 219/264, 265

[56] References Cited

U.S. PATENT DOCUMENTS

| | | | |
|---|---|---|---|
| 3,147,354 | 9/1964 | Hewitt, Jr. | 337/103 |
| 3,167,643 | 1/1965 | Turner | 337/103 X |
| 4,200,857 | 4/1980 | Sato et al. | 338/162 X |

*Primary Examiner*—C. L. Albritton

*Attorney, Agent, or Firm*—Sughrue, Mion, Zinn, Macpeak & Seas

[57] ABSTRACT

A variable resistor having a short-circuiting member which is displaced in response to the generation of abnormally high heat in the resistance member of the variable resistor with a piece thereof in contact to short-circuit the input and output terminals of the resistance member. This results in a bypass for large current, so that a protection circuit in an output amplifier is operated to suspend the generation of heat.

15 Claims, 19 Drawing Figures

VARIABLE RESISTOR

BACKGROUND OF THE INVENTION

This invention relates to a circuit which is connected in a circuit extended from a power amplifier to loudspeakers thereof for balancing the sound volumes of the right and left loudspeakers or of the front and rear loudspeakers. This is, this invention relates to a variable resistor employed in a fader control circuit.

The fader control circuit is extensively employed for car radio receiver sets. For instance, in the case where a radio receiver set is provided near the operator's seat of a car, the fader control circuit is used so that the sound volumes of the right and left loudspeakers or of the front and rear loudspeakers can be balanced by a person on the rear seat. Alternatively, in the case where the loudspeakers are positioned at the right, left, front and rear sides of a person, the fader control circuit is used to adjust (balance) the sound volumes of the front and rear loudspeakers by adjusting the outputs of the right and left power amplifiers. In other words, the circuit is used to control the output of a power amplifier with a variable resistor.

Examples of the fader control circuit are as shown in FIGS. 1 and 2, which comprises: a power amplifier A, which can be either the right and left, or front and rear, loudspeakers $SP_1$ and $SP_2$; and a variable resistor VR for adjusting output levels applied to the loudspeakers $SP_1$ and $SP_2$. As the sliding piece (wiper) of the variable resistor VR is moved, the power applied to the loudspeakers $SP_1$ and $SP_2$ is changed; that is, the sound volumes of the loudspeakers are changed.

In general, the variable resistor VR is 40 to 80Ω in maximum resistance and 10 watts in capacity. The output power of the power amplifier A is, by comparison high, 20 to 40 watts in maximum in the car of automobile hifi equipment. Accordingly, when the input and output terminals of the variable resistor VR are shorted or opened, i.e. when for instance the voice coil of the loudspeaker $SP_1$ is shorted or the voice coil of the loudspeaker $SP_2$ is broken, and the sliding piece of the variable resistor is positioned as indicated by the dotted line in the figure, then all of the output current of the power amplifier A is caused to flow through a small part R of the resistance member of the variable resistor VR. As a result, heat is abnormally generated in the small part R while increasing the temperature thereof to, for instance, several hundreds of degrees. This temperature increase may cause a fire.

In order to eliminate this difficulty, or to prevent such a fire, heretofore a method is employed in which a protection circuit is provided in a relevant device to detect the short-circuiting of one or both output terminals of the variable resistor. When this occurs the device is deenergized when the short-circuiting occurs. However, the method is disadvantageous in that the protection circuit is expensive and the operation thereof is relatively unreliable.

SUMMARY OF THE INVENTION

In view of the foregoing, an object of the invention is to provide a variable resistor in which, when heat is abnormally generated in the resistance member, a heat-sensitive element or a spring member is displaced in response to the generation of abnormal heat to disconnect the resistance member from the conductor or to short-circuit the input and output terminals of the resistance member.

It is another object of this invention to provide a variable resistor that will actuate the protection circuit of a revelant amplifier is operated to interrupt the supply of current thereto thereby to suspend the generation of heat therein.

These and other objects of this invention are attained by a variable resistor having a heat responsive member that is displaced by abnormal heat generation to short circuit the input and output terminals of the resistance member. The heat responsive member may be mounted on the terminal substrate or the resistor cap. It may be limiter, a fuse member, or a thermally expandable element. The heat responsive member may be biased out of contact until heat generation causes deflection. In any embodiment, the bypass caused by the short circuit action actuates a protection circuit in an output amplifier to suspend the application of current and the generation of heat.

This invention will be described in detail with respect to the accompanying drawing and the description of the preferred embodiments that follow.

DESCRIPTION OF THE PREFERRED EMBODIMENTS

Figure 1:
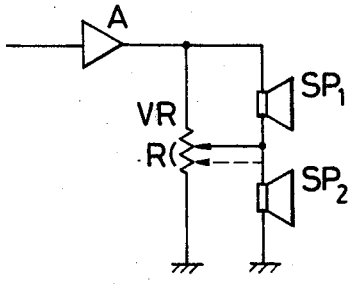
FIG. 1 is a circuit drawing of a first example of a fader control circuit.
Figure 2:
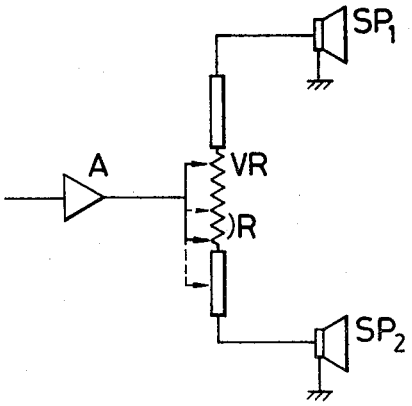
FIG. 2 is a circuit drawing of a second example of a fader control circuit.
Figure 3:
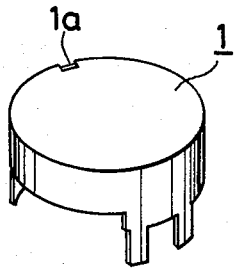
FIG. 3 is an exploded perspective view of a first embodiment of this invention.
Figure 3:
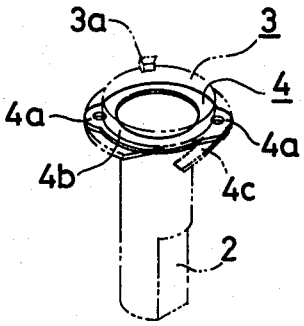
Figure 3:
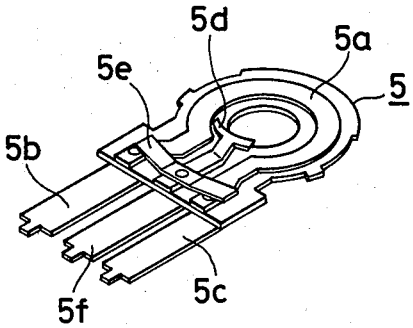
Figure 4:
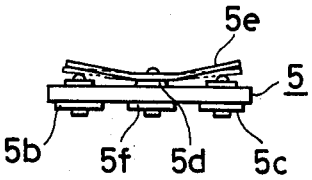
FIG. 4 is a side elevation view of the substrate showing the position of the bimetal.

A first embodiment of a variable resistor according to this invention, as shown in FIGS. 3 and 4 comprises: a metal case 1 having a stopper 1*a* protruded inwardly. A shaft 2 has a mounting board 3 fixedly secured to it having an abutting protrusion 3*a* which is formed on the upper surface thereof to abut against the stopper 1*a*. The protrusion 3*a* prevents the mounting board 3 from being turned through 360°. A ring 4 made of conductive material comprises a sliding ring 4*b* having small holes 4*a* which are engaged with and welded to protrusions formed on the lower surface of the mounting board 3, and a sliding piece 4*c* extended from the sliding ring 4*b*.

The variable resistor further comprises a substrate 5 made of bakelite or the like. Formed on the substrate 5 is a substantially annular resistance member 5*a* along which the sliding piece 4*a* is allowed to slide. Both ends of the resistance member 5*a* are connected to terminal boards 5*b* and 5*c*, respectively, which are secured with eyelets or the like. In the substrate 5, a sliding piece 5*d* which is slidably in contact with the above-described sliding ring 4*b*, and a bimetal 5*e* are connected to a terminal board 5*f* with an eyelet or the like, in such a manner that both ends of the bimetal 5*e* confront with the terminal boards 5*b* and 5*c*.

The mounting board 3 is inserted in the case 1, and the substrate 5 is mounted in the case. As a result, the sliding piece 4*c* and the sliding piece 5*d* are brought slidably in contact with the resistance member 5*a* and the sliding ring 4*b*, respectively.

When the sliding piece 4*c* is moved near the end of the resistance member 5*a*; i.e. when the resistance of 5*a* is decreased (to about 2Ω), then large current flows in the resistance member 5*a* with the result that heat abnormally high in temperature is generated therein. The bimetal 5*e* is deformed (bent) by this heat, so that both ends of the bimetal 5*e* are brought into contact with the terminal boards 5*b* and 5*c*, (FIG. 4, dotted line) respectively, to short the two ends of the resistance member 5*a*. Accordingly, if, in this operation, a protection circuit connected to the variable resistor and operating in response to this short-circuiting is provided in an amplifier, then the flow of current to the variable resistor is interrupted to stop the generation of heat in the resistance member.

Figure 5:
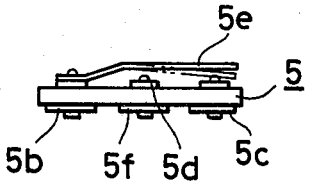
FIG. 5 is a side elevation view of a modification of the first embodiment wherein the bimetal is connected to an end terminal board.

In the example shown in FIGS. 3 and 4, the bimetal 5*e* is fixedly secured to the terminal board 5*f*, and the terminal board 5*f* is connected to the terminal boards 5*b* and 5*c* by the operating of the bimetal 5*e*. However, the invention is not limited thereto or thereby; that is, the variable resistor may be designed so that the bimetal 5*e* is mounted on the terminal board 5*b*, and the terminal boards 5*b* and 5*c* are short-circuited by the bimetal 5*e*. This is shown in FIG. 5. In other words, all that is necessary is to short-circuit the input and output terminals of the resistance member 5*a* with the bimetal 5*e*.

Figure 6:
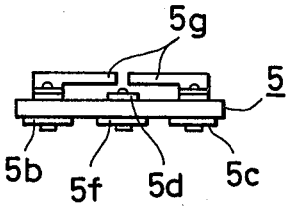
FIG. 6 is a side elevation view of a second modification of the first embodiment utilizing two members of high large thermal expansion coefficient.

Furthermore, the short-circuit member is not limited to the bimetal as shown in the first embodiment. That is, the variable resistor may be designed so that, as shown in FIG. 6, electrically conductive pieces 5*g* having a large coefficient of thermal expansion are fixedly secured to the terminal boards 5*b* and 5*c* in such a manner that they confront each other. In this case, the electrically conductive pieces 5*g* are expanded by the abnormal heat generation in the resistance member 5*a* to contact each other and short-circuit the input and output terminals of the resistance member 5*a*.

Figure 7:
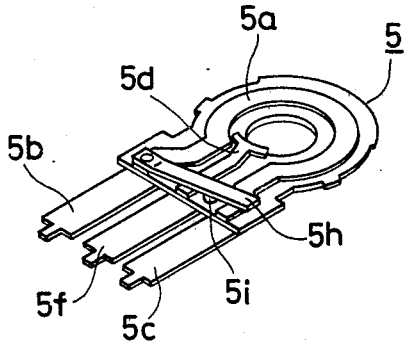
FIG. 7 is a perspective view of a substrate and terminal members in accordance with a third modification of the high embodiment of this invention.
Figure 8:
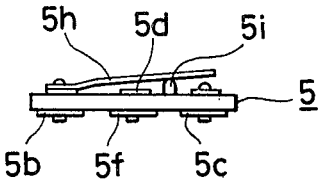
FIG. 8 is a side elevation view of the substrate of FIG. 7.

FIGS. 7 and 8 show a third modification of short-circuiting the terminal boards 5*b* and 5*c*. A spring member 5*h* is fixedly secured to the terminal board 5*b* at one end in such a manner that the middle portion of the spring member is supported by a thermally deformable member 5*i*, which is readily molten by heat. The member 5*i* serves to prevent the spring member 5*h* from being brought into contact with the terminal board during the normal operation. When the thermally deformable member 5*i* is melted by the abnormal heat generation in the resistance member 5*a*, the spring member 5*h* is brought into contact with the terminal board 5*c*. That is, the terminal boards 5*b* and 5*c* are short-circuited by the spring member 5*h*.

In the above-described examples of the variable resistor, the terminal boards 5*b* and 5*c* are short-circuited by utilizing a heat-sensitive element or the like and the short-circuiting operation is detected by the protection circuit in the amplifier, to interrupt the current to prevent the generation of heat in the resistance member. However, it should be noted that the invention is not limited thereto or thereby. That is, the variable resistor may be designed so that the heat-sensitive element or the like is displaced by the generation of heat in the resistance member, to disconnect the resistance member from the conductor, thereby to suspend the generation of heat in the resistance member.

Figure 9:
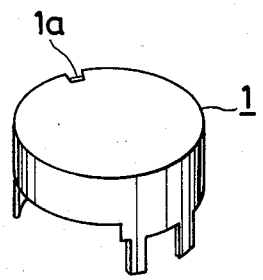
FIG. 9 is an exploded perspective view of a second embodiment of this invention.
Figure 9:
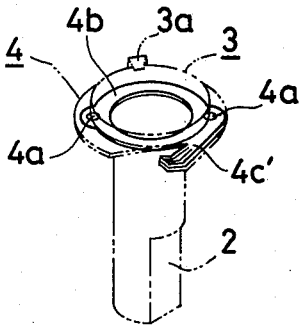
Figure 9:
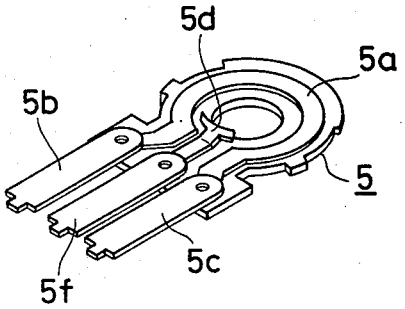
Figure 10:
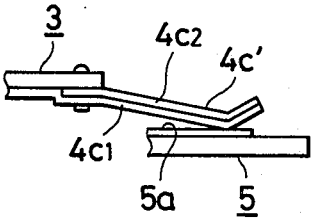
FIG. 10 is a side elevation view of the sliding piece 4*c*′ shown in FIG. 9.
Figure 11:
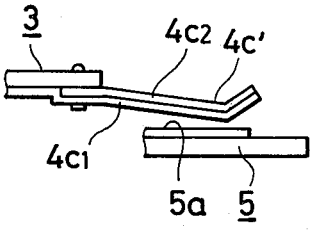
FIG. 11 is a side elevation of the sliding piece showing the state of bending the sliding piece.

Other embodiments of the variable resistor according to this aspect of the invention will now be described. One of the examples is as shown in FIG. 9 which is an exploded view thereof. In FIG. 9, those components which have been previously described with reference to FIG. 3 have therefore been similarly numbered. In this embodiment, a sliding piece 4*c*′ is made up as shown in FIG. 10 of two metal pieces 4*c*1 and 4*c*2 different in thermal expansion coefficient. The thermal expansion coefficient of the metal piece 4*c*1 is much larger than that of the metal piece 4*c*2. The section of the sliding piece 4*c*′ is as shown in FIG. 10 or 11. That is, as is apparent from the above-description and FIGS. 10 and 11, the sliding piece 4*c*′ is a bimetal. Accordingly, when heat is generated in the resistance member, then the sliding piece 4*c*′ is bent as shown in FIG. 11. As a result, the resistance member is disconnected from the conductor, to suspend the generation of heat in the resistance member. Accordingly, in this example, it is unnecessary to provide the bimetal 5*e* shown in FIG. 3.

In the embodiment shown in FIGS. 9, 10 and 11, the sliding piece (bimetal) 4*c*′ is extended from the ring 4. However, the same effect can be obtained by providing a bimetal similar in structure to the sliding piece 4*c*′ for the sliding piece 5*d* fixedly secured to the substrate 5.

Figure 12:
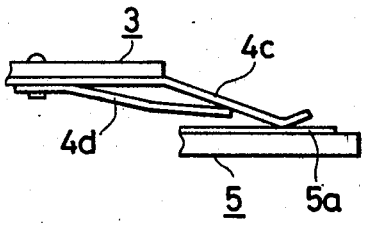
FIGS. 12 and 13 are side elevation views of the sliding piece according to a second example of the second embodiment according to this invention.
Figure 13:
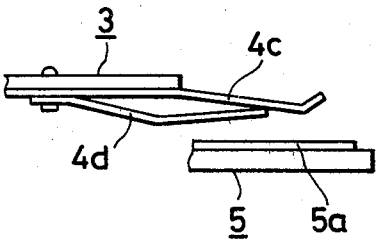

A second example of the second embodiment of the sliding piece 4*c* will be described with reference to FIGS. 12 and 13.

In this example, the sliding piece 4*c* is similar to that shown in FIG. 3. However, it should be noted that the sliding piece 4*c* together with a bimetal 4*d* is secured to the mounting board 3 as shown in FIG. 12, in such a manner that the end of the bimetal 4*d* is in contact with the sliding piece 4*c* or slightly apart therefrom. When heat is generated in the resistance member, the bimetal 4*d* is bent upwardly as shown in FIG. 13, and accordingly, the sliding piece 4*c* is bent upwardly by the bimetal 4*d* thus bent. As a result, the end of the sliding piece 4*c* is disconnected from the resistance member 5*a* as shown in FIG. 13, and the generation of heat in the resistance member 5*a* is suspended.

Also, as in the previously described example, the structure may be applied to the sliding piece 5*d*.

Figure 14:
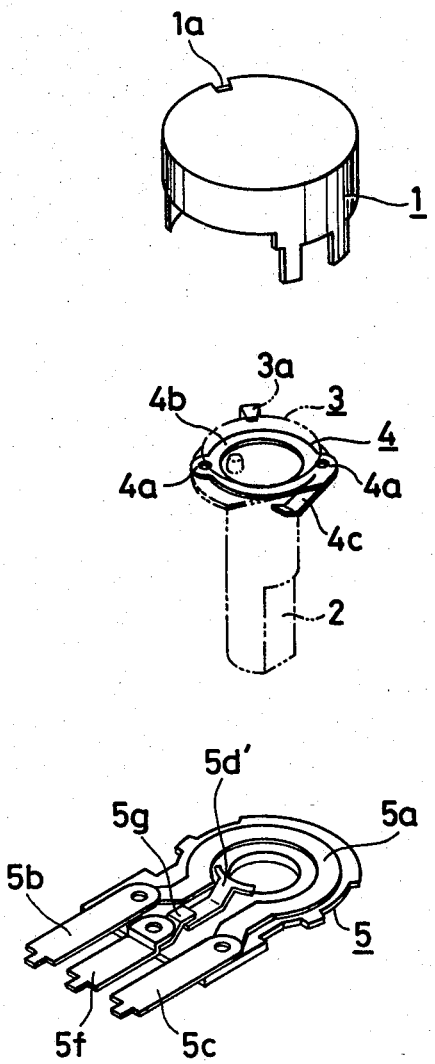
FIG. 14 is an exploded perspective view of a third embodiment of this invention.
Figure 15:
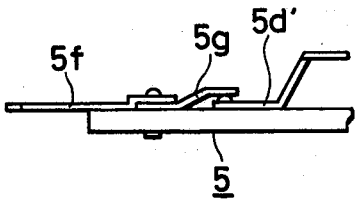
FIGS. 15 and 16 are side elevation views of the sliding piece according to the third embodiment.
Figure 16:
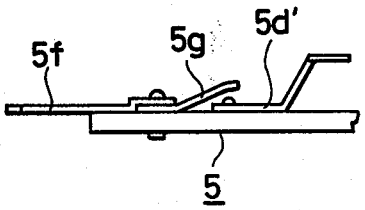

FIGS. 14 through 16 show a third embodiment of the variable resistor which provides the same effect as described above. This embodiment is similar to that shown in FIG. 3 except the connection between the sliding piece 5*d* and the terminal board 5*f*. As is apparent from FIGS. 15 and 16, a sliding piece 5*d'* is fixedly secured to the substrate 5 with an eyelet or the like. The terminal board 5*f* and a bimetal 5*g* (not shown in FIG. 3) are fixedly secured to the substrate by means of an eyelet or the like in such a manner that the end portion of the bimetal 5*g* is in contact with the eyelet which has fixedly secured the sliding piece 5*d'* to the substrate 5. When heat is generated in the resistance member 5, then the bimetal 5*g* is bent as shown in FIG. 16; that is, the end portion of the bimetal 5*g* is disconnected from the eyelet of the sliding piece 5*d'*. As a result, the current flowing in the resistance member 5*a* through the sliding piece 5*d'*; is interrupted, and the generation of heat is suspended.

In this embodiment, the bimetal 5*g* is connected to the terminal board 5*f*. Alternatively, the bimetal 5*g* may be provided at least one of the positions between the terminal boards 5*b*, 5*c* and 5*e* and the resistance member 5*a* to interrupt the current in the resistance member 5*a*.

Another embodiment of the variable resistor according to the invention will be described with reference to FIGS. 17, 18 and 19. In the variable resistor, a heat-sensitive element or a heat-sensitive switch is utilized to interrupt the supply of current to a relevant device, to prevent the generation of heat.

Figure 17:
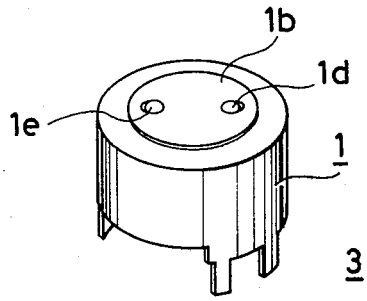
FIG. 17 is an exploded perspective view of a fourth embodiment of this invention.
Figure 18:
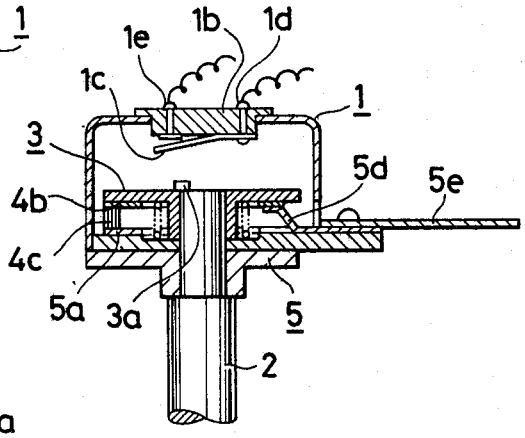
FIGS. 18 and 19 are side cross sectional views of two examples of the fourth embodiment of this invention.
Figure 18:
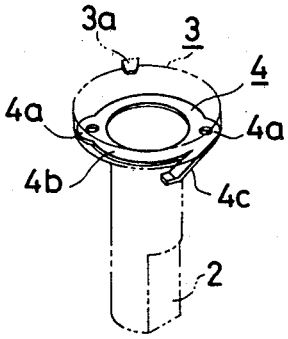
Figure 19:
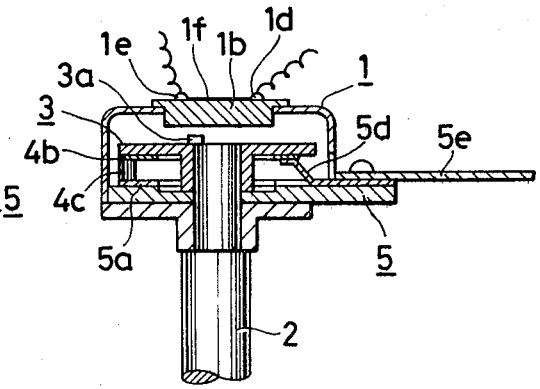
Figure 19:
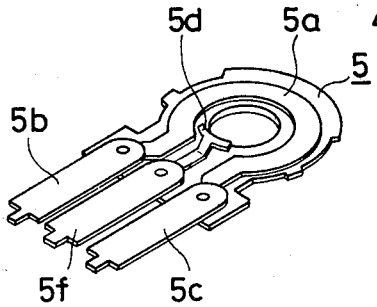

The variable resistor shown in fourth embodiment of FIGS. 17 through 19 is similar to the one shown in FIG. 3 except the structure of its case 1. An insulation substrate 1*b* made of electrically insulating material which is high in heat conduction is provided on the top of the metal case 1. One end of a bimetal 1*c* is fixedly secured to the insulation substrate 1*b* with a pin 1*d*, while the other end thereof is in contact with another pin 1*e* as shown in FIG. 18. The other ends of the pins 1*d* and 1*e* are exposed in the outer surface of the insulation substrate 1*b* and can be connected to lead wires.

When the resistance member 5*a* is heated, then the case 1 itself and the inside thereof are heated and as a result, the bimetal 1*c* is bent to be disconnected from the point 1*e*. Thus, if the power lines of a relevant device are connected to the pins 1*d* and 1*e*, then the power source to the entire device is interrupted by the operation of the bimetal 1*c* as described above, thereby to prevent the generation of heat in the device.

In the above-described embodiment, the pin 1*d* is electrically disconnected from the pin 1*e* by the generation of heat; however, the variable resistor may be designed so that these pins 1*d* and 1*e* are short-circuited. In this case, as in the embodiment described with reference to FIG. 3, it is necessary to provide a protection circuit in the amplifier, which operates in response to the short-circuiting.

Instead of the bimetal 1*c*, a thermo-fuse 1*f* may be connected between the pins 1*d* and 1*e* as shown in FIG. 19. As the fuse 1*f* is molten by heating, the supply of current to the device can be interrupted similarly as in the above-described example. Furthermore, a method may be employed for the variable resistor, in which a heat-sensitive resistance element is connected between the pins 1*d* and 1*e*, and the variation in resistance of the resistance element is detected so that the supply of current is interrupted or protection circuit is operated.

As is apparent from the above description, according to the invention, when heat is generated in the resistance member of the variable resistor, the heat-sensitive element or the spring member is displaced to electrically disconnect the resistance member from the conductor, or the input and output terminals of the resistance member are short-circuited, whereby the protection circuit in the amplifier is operated to suspend the supply of current and the generation of heat in the resistance member. Thus, a fire attributed to the generation of heat can be positively prevented, according to the invention.

What is claimed is:

1. A variable resistor comprising a casing, a sliding member mounted in said casing and a substrate member having a resistance member in sliding contact with said sliding member, terminal members coupled to said resistance member, and bimetal strip means responsive to heat inside said casing to terminate the application of current through said variable resistor, said terminal members including terminal boards mounted on said substrate, and said bimetal strip being coupled to one of said terminal members.

2. The variable resistor of claim 1 wherein there are at least three terminal boards and said bimetal is coupled to one of said terminal boards and extends across the other two whereby upon heating said bimetal deforms to contact at least one other terminal board and short circuit said variable resistor.

3. The variable resistor of claim 2 wherein said bimetal is mounted on a center terminal board and extends over two outer terminal boards.

4. The variable resistor of claim 2 wherein said bimetal is mounted on an outer terminal board and extends across the remaining terminal boards.

5. The variable resistor of claim 1 wherein said bimetal is coupled between one terminal member and said a sliding member mounted on said substrate, whereby upon application of heat said bimetal bends to discontinue the application of current to said variable resistor.

6. The variable resistor of claim 1 wherein said bimetal contacts said sliding member.

7. The variable resistor of claim 6 wherein said bimetal forms a portion of said sliding member in contact with said resistance member and whereby upon application of heat said bimetal is deformed to disconnect said sliding member from said resistance member.

8. The variable resistor of claim 6 wherein bimetal forms an element contacting a portion of said sliding member wherein upon the application of heat said bimetal deforms to urge said sliding member out of contact with said resistance member.

9. The variable resistor of claim 8 wherein said bimetal is disposed between said sliding member and said resistance member.

10. The variable resistor of claim 1 wherein said bimetal is mounted in said casing across lead wires.

11. The variable resistor of claim 1 wherein said means responsive to heat comprises a meltable member.

12. The variable resistor of claim 11 wherein said meltable member is mounted relative to said terminal members, a conductive element coupled to one terminal member and held out of contact with said other terminal members by said meltable member until it melts.

13. The variable resistor of claim 11 wherein said meltable member comprises a fuse element mounted in said casing across lead wires.

14. The variable resistor of claim 1 wherein said means responsive to heat comprises segments having a large coefficient of thermal expansion secured to said terminal members.

15. The variable resistor of claim 14 wherein said segments are coupled to two terminal members and positioned to expand into contact with each other and short circuit said terminal members upon the application of heat.

* * * * *